US012331477B2

(12) United States Patent
Frost et al.

(10) Patent No.: US 12,331,477 B2
(45) Date of Patent: Jun. 17, 2025

(54) GROUND ANCHORING APPARATUS AND METHOD

(71) Applicant: GEORGIA TECH RESEARCH CORPORATION, Atlanta, GA (US)

(72) Inventors: James David Frost, Atlanta, GA (US); John A. Huntoon, Atlanta, GA (US); Seth D. Mallett, Atlanta, GA (US)

(73) Assignee: GEORGIA TECH RESEARCH CORPORATION, Atlanta, GA (US)

( * ) Notice: Subject to any disclaimer, the term of this patent is extended or adjusted under 35 U.S.C. 154(b) by 0 days.

(21) Appl. No.: 17/915,900

(22) PCT Filed: Apr. 2, 2021

(86) PCT No.: PCT/US2021/025490
§ 371 (c)(1),
(2) Date: Sep. 29, 2022

(87) PCT Pub. No.: WO2021/202944
PCT Pub. Date: Oct. 7, 2021

(65) Prior Publication Data

US 2023/0151576 A1 May 18, 2023

Related U.S. Application Data

(60) Provisional application No. 63/004,783, filed on Apr. 3, 2020.

(51) Int. Cl.
*E02D 5/80* (2006.01)

(52) U.S. Cl.
CPC ..... *E02D 5/803* (2013.01); *E02D 2600/30* (2013.01)

(58) Field of Classification Search
CPC ..... E02D 2600/30; E02D 5/803
(Continued)

(56) References Cited

U.S. PATENT DOCUMENTS 640,360 A * 1/1900 McBride ..... B63B 21/243 114/305
912,018 A 2/1909 McNutt
(Continued)

FOREIGN PATENT DOCUMENTS

JP S5379711 U 7/1978
JP S53105405 U 8/1978
(Continued)

OTHER PUBLICATIONS

European Search Report received in corresponding European Application No. 21780634.8 dated Apr. 3, 2024, 10 pages.
(Continued)

*Primary Examiner* — James J Buckle, Jr.
(74) *Attorney, Agent, or Firm* — Meunier Carlin & Curfman LLC

(57) ABSTRACT

Various implementations include a ground anchoring apparatus including a longitudinal body, first and second retaining members, and a set of expanding linkage assemblies. The first retaining member is rigidly coupled to the longitudinal body. The second retaining member is movably coupled to the longitudinal body. Each expanding linkage assembly includes first and second linkage members. The first linkage member has first and second portions, and the second linkage member has third and fourth portions. The first portion is rotatably coupled to the first retaining member. The fourth portion is rotatably coupled to the second retaining member. The third portion is rotatably coupled to the second portion. The set of expanding linkage assemblies is movable between a collapsed and expanded configuration. The second retaining member is closer to the first retaining member and the third portion is further from the central axis in the expanded configuration than in the collapsed configuration.

26 Claims, 9 Drawing Sheets

(58) Field of Classification Search
USPC ..... 52/162
See application file for complete search history.

(56) References Cited

U.S. PATENT DOCUMENTS

| | | | | | |
|---|---|---|---|---|---|
| 2,873,829 | A | | 2/1959 | Wiegmann | |
| 3,187,858 | A | | 6/1965 | Des Champs | |
| 3,653,355 | A | * | 4/1972 | Christians | B63B 21/28 114/295 |
| 3,825,077 | A | | 7/1974 | Jackson | |
| 3,935,912 | A | * | 2/1976 | Shibata | E02D 5/803 175/264 |
| 4,015,433 | A | * | 4/1977 | Shibata | E02D 5/54 405/259.5 |
| 4,189,879 | A | * | 2/1980 | Patterson | E02D 5/803 52/161 |
| 4,547,106 | A | * | 10/1985 | Lipsker | E02D 5/803 405/262 |
| 4,576,521 | A | * | 3/1986 | Conrad | E02D 5/808 405/226 |
| 4,592,178 | A | * | 6/1986 | Lu | E02D 5/803 52/166 |
| 4,697,394 | A | * | 10/1987 | Lu | E02D 5/803 411/432 |
| 10,801,175 | B2 | * | 10/2020 | Evirgen | E02D 7/22 |

FOREIGN PATENT DOCUMENTS

| | | | |
|---|---|---|---|
| JP | S5756881 | U | 4/1982 |
| JP | 2006336387 | A | 12/2006 |
| JP | 2019035191 | A | 3/2019 |
| KR | 200392328 | Y1 | 8/2005 |

OTHER PUBLICATIONS

Office Action received in corresponding Canadian Application No. 3,174,127 dated Apr. 9, 2024, 3 pages.
International Search Report and Written Opinion received in PCT/US2021/025490 dated Jun. 30, 2021, 10 pages.
Office Action received in corresponding Japanese Application No. 2022-559963, dated Jan. 7, 2025.

* cited by examiner

GROUND ANCHORING APPARATUS AND METHOD

RELATED APPLICATION

This application is a national stage application filed under 35 U.S.C. § 371 of PCT/US2021/025490 filed Apr. 2, 2021, which claims priority to, and the benefit of, U.S. Provisional Patent Application No. 63/004,783, filed Apr. 3, 2020, entitled "GROUND ANCHOR AND INSTALLATION PROCEDURE," which is incorporated by reference herein in its entirety.

STATEMENT OF GOVERNMENT INTEREST

This invention was made with government support under EEC-1449501 awarded by the National Science Foundation. The government has certain rights in the invention.

BACKGROUND

Ground anchors are used in civil engineering applications to couple structures such as retaining walls, soldier pile walls, contiguous pile walls, or sheet pile walls as well as building structures or bridge structures to a ground surface or section and to transfer loads to the ground. A ground opening is formed in the ground surface, and the ground anchor is inserted into the ground opening. The openings can be made tens of feet (e.g., greater than 10 feet) to hundreds of feet below the ground surface. Then, the unfilled ground opening is typically filled with backfill.

Existing ground anchors typically include cylindrical critical surface geometry structure over which shear strength is exerted. The structure is generally placed at the end of a long shaft. Existing ground anchors alternatively use helical structures.

Furthermore, in some situations in which underground space is limited, the length of traditional ground anchors may not provide enough capacity for a desired application.

There is a benefit to having ground anchors with increased capacity relative to the ground anchors' length.

SUMMARY

Various implementations include a ground anchoring apparatus. The ground anchoring apparatus include a first longitudinal body, a first retaining member, a second retaining member, and a first set of one or more expanding linkage assemblies. The first longitudinal body has a central axis. The first retaining member (e.g., collar, wall of the stressing element) is rigidly coupled to a portion of the first longitudinal body. The second retaining member is movably coupled (e.g., slidably coupled) to the first longitudinal body. Each of the one or more expanding linkage assemblies of the first set of one or more expanding linkage assemblies includes a first linkage member and a second linkage member. The first linkage member has a first portion and a second portion opposite and spaced apart from the first portion. The first portion of the first linkage member is rotatably coupled to the first retaining member. The second linkage member has a third portion and a fourth portion opposite and spaced apart from the third portion. The fourth portion of the second linkage member is rotatably coupled to the second retaining member. The third portion of the second linkage member is rotatably coupled to the second portion of the first linkage member. The first set of one or more expanding linkage assemblies is movable between a collapsed configuration and an expanded configuration. The second retaining member is closer to the first retaining member and the third portion of the second linkage member is further from the central axis in the expanded configuration than in the collapsed configuration.

In some implementations, the ground anchoring apparatus further includes a second longitudinal body having an engagement surface that abuts the second retaining member to move the first set of one or more expanding linkage assemblies from the collapsed configuration to the expanded configuration. In some implementations, the second longitudinal body has a proximal end and a distal end opposite and spaced apart from the proximal end. The proximal end of the second longitudinal body defines a central bore extending to the distal end. The central bore is sized such that the first longitudinal body is slidingly disposable within the central bore.

In some implementations, the ground anchoring apparatus further includes a jack for causing the second longitudinal body to move toward the first retaining member when the engagement surface of the second longitudinal body abuts the second retaining member. In some implementations, the first longitudinal body includes an outer threaded portion and the jack includes an inner threaded portion. The inner threaded portion is configured to engage the outer threaded portion such that rotation of the inner threaded portion of the jack about the central axis causes the jack to move axially along the first longitudinal body.

In some implementations, the ground anchoring apparatus further includes one or more centralizers. Each of the one or more centralizers includes a resilient body defining a centralizer opening. The resilient body is biased toward a first centralizer position in which the centralizer opening has a first diameter and the resilient body is urgable toward a second centralizer position in which the centralizer opening has a second diameter. The second diameter is greater than the first diameter. In some implementations, the resilient body includes a first body end, a second body end opposite and spaced apart from the first body end, and one or more resilient slats extending between the first body end and the second body end. A portion of the one or more resilient slats at least partially defines the centralizer opening. In some implementations, the second diameter is sized such that the second longitudinal body is slidingly disposable within the centralizer opening. The first diameter is sized such that the first longitudinal body is slidingly disposable within the centralizer opening. In some implementations, the first longitudinal body has a proximal end and a distal end opposite and spaced apart from the proximal end. The one or more centralizers include at least a first centralizer and a second centralizer, wherein the first centralizer is tethered to the first retaining member or a portion of the first longitudinal body between the first retaining member and the distal end of the first longitudinal body, and wherein the second centralizer is tethered to the first centralizer and to a portion of the first longitudinal body between the second longitudinal body and the proximal end of the first longitudinal body.

In some implementations, the ground anchoring apparatus further includes a lock for preventing the first set of one or more expanding linkage assemblies from moving from the expanded configuration to the collapsed configuration.

In some implementations, the first linkage member has a length as measured from the first portion to the second portion and the second linkage member has a length as measured from the third portion to the fourth portion. The length of the second linkage member is longer than the length of the first linkage member.

In some implementations, the first longitudinal body has a proximal end and a distal end opposite and spaced apart from the proximal end. The first retaining member is rigidly coupled adjacent the distal end of the first longitudinal body.

In some implementations, the first portion of the first linkage member is rotatably coupled to the first retaining member by a first hinge, and the fourth portion of the second linkage member is rotatably coupled to the second retaining member by a second hinge.

In some implementations, each of the one or more second linkage members further includes a linkage cover coupled to the second linkage member. The linkage cover has a width that is greater than a width of the second linkage member.

In some implementations, the first retaining member and the second retaining member each include an annular body and one or more flanges. The annular body defines an opening sized such that the first longitudinal body is disposable within the opening. Each of the one or more flanges extends radially from the annular body. The one or more flanges of the first retaining member are rotatably coupled to the first portion of the first linkage member and the one or more flanges of the second retaining member are rotatably coupled to the fourth portion of the second linkage member of one of the one or more expanding linkage assemblies.

In some implementations, the ground anchoring apparatus further includes a third retaining member, a fourth retaining member, and a second set of one or more expanding linkage assemblies. The third retaining member is rigidly coupled to another portion of the first longitudinal body. The fourth retaining member is movably coupled to the first longitudinal body. Each of the one or more expanding linkage assemblies includes a first linkage member and a second linkage member. The first linkage member has a first portion and a second portion opposite and spaced apart from the first portion. The first portion of the first linkage member is rotatably coupled to the first retaining member. The second linkage member has a third portion and a fourth portion opposite and spaced apart from the third portion. The fourth portion of the second linkage member is rotatably coupled to the second retaining member. The third portion of the second linkage member is rotatably coupled to the second portion of the first linkage member. The second set of one or more expanding linkage assemblies is movable between a collapsed configuration and an expanded configuration. The second retaining member is closer to the first retaining member and the third portion of the second linkage member is further from the central axis in the expanded configuration than in the collapsed configuration.

In some implementations, the second retaining member is disposed closer to the third retaining member than to the fourth retaining member, and the second retaining member is axially spaced apart from the third retaining member.

In some implementations, the one or more expanding linkage assemblies includes two or more expanding linkage assemblies. In some implementations, the two or more expanding linkage assemblies includes three or more expanding linkage assemblies. In some implementations, the two or more expanding linkage assemblies includes six or more expanding linkage assemblies.

In some implementations, the first longitudinal body comprises metal.

In some implementations, the first longitudinal body can withstand at least a 5,000-pound tensile load. In some implementations, the first longitudinal body can withstand at least a 5,000-pound compressive load.

Various implementations include a method of using a ground anchoring apparatus. The method includes disposing a ground anchoring apparatus within a ground opening, disposing a backfill within the ground opening, and causing the first set of one or more expanding linkage assemblies to move from the collapsed configuration to the expanded configuration. The ground anchoring apparatus include a first longitudinal body, a first retaining member, a second retaining member, and a first set of one or more expanding linkage assemblies. The first longitudinal body has a central axis. The first retaining member (e.g., collar, wall of the stressing element) is rigidly coupled to a portion of the first longitudinal body. The second retaining member is movably coupled (e.g., slidably coupled) to the first longitudinal body. Each of the one or more expanding linkage assemblies of the first set of one or more expanding linkage assemblies includes a first linkage member and a second linkage member. The first linkage member has a first portion and a second portion opposite and spaced apart from the first portion. The first portion of the first linkage member is rotatably coupled to the first retaining member. The second linkage member has a third portion and a fourth portion opposite and spaced apart from the third portion. The fourth portion of the second linkage member is rotatably coupled to the second retaining member. The third portion of the second linkage member is rotatably coupled to the second portion of the first linkage member. The first set of one or more expanding linkage assemblies is movable between a collapsed configuration and an expanded configuration. The second retaining member is closer to the first retaining member and the third portion of the second linkage member is further from the central axis in the expanded configuration than in the collapsed configuration.

In some implementations, the method further includes forming the ground opening.

In some implementations, the ground anchoring system further includes a second longitudinal body having an engagement surface and causing the first set of one or more expanding linkage assemblies to move from the collapsed configuration to the expanded configuration includes disposing the second longitudinal body within the ground opening and abutting the engagement surface against the second retaining member and moving the first set of one or more expanding linkage assemblies from the collapsed configuration to the expanded configuration. In some implementations, the second longitudinal body has a proximal end and a distal end opposite and spaced apart from the proximal end. The proximal end of the second longitudinal body defines a central bore extending to the distal end. The first longitudinal body is slidingly disposes within the central bore.

In some implementations, the method further includes removing the second longitudinal body from the ground opening after causing the first set of one or more expanding linkage assemblies to move from the collapsed configuration to the expanded configuration.

In some implementations, the ground anchoring system further includes a jack and causing the first set of one or more expanding linkage assemblies to move from the collapsed configuration to the expanded configuration includes using the jack to cause the second longitudinal body to move toward the first retaining member when the engagement surface of the second longitudinal body is abutting the second retaining member.

In some implementations, the first longitudinal body includes an outer threaded portion and the jack includes an inner threaded portion. The inner threaded portion is configured to engage the outer threaded portion such that rotation of the inner threaded portion of the jack about the central axis causes the jack to move axially along the first longitudinal body.

In some implementations, the ground anchoring system further includes one or more centralizers. Each of the one or more centralizers includes a resilient body defining a centralizer opening. The first longitudinal body is disposed within the centralizer opening. The resilient body is biased toward a first centralizer position in which the centralizer opening has a first diameter and the resilient body is urgable toward a second centralizer position in which the centralizer opening has a second diameter. The second diameter is greater than the first diameter. In some implementations, the resilient body includes a first body end, a second body end opposite and spaced apart from the first body end, and one or more resilient slats extending between the first body end and the second body end. A portion of the one or more resilient slats at least partially defines the centralizer opening. In some implementations, the second diameter is sized such that the second longitudinal body is disposed within the centralizer opening, and the first diameter is sized such that the first longitudinal body is slidingly disposable within the centralizer opening. In some implementations, the first longitudinal body has a proximal end and a distal end opposite and spaced apart from the proximal end. The one or more centralizers include at least a first centralizer and a second centralizer. The first centralizer is tethered to the first retaining member or a portion of the first longitudinal body between the first retaining member and the distal end of the first longitudinal body, and the second centralizer is tethered to the first centralizer and to a portion of the first longitudinal body between the second longitudinal body and the proximal end of the first longitudinal body.

In some implementations, the ground anchoring apparatus further includes a lock for preventing the first set of one or more expanding linkage assemblies from moving from the expanded configuration to the collapsed configuration.

In some implementations, the first linkage member has a length as measured from the first portion to the second portion and the second linkage member has a length as measured from the third portion to the fourth portion. The length of the second linkage member is longer than the length of the first linkage member.

In some implementations, the first longitudinal body has a proximal end and a distal end opposite and spaced apart from the proximal end. The first retaining member is rigidly coupled adjacent the distal end of the first longitudinal body.

In some implementations, the first portion of the first linkage member is rotatably coupled to the first retaining member by a first hinge, and the fourth portion of the second linkage member is rotatably coupled to the second retaining member by a second hinge.

In some implementations, each of the one or more second linkage members further include a linkage cover coupled to the second linkage member. The linkage cover has a width that is greater than a width of the second linkage member.

In some implementations, the first retaining member and the second retaining member each include an annular body and one or more flanges. The annular body defines an opening sized such that the first longitudinal body is disposable within the opening. Each of the one or more flanges extends radially from the annular body. The one or more flanges of the first retaining member are rotatably coupled to the first portion of the first linkage member and the one or more flanges of the second retaining member are rotatably coupled to the fourth portion of the second linkage member of one of the one or more expanding linkage assemblies.

In some implementations, the ground anchoring apparatus further includes a third retaining member, a fourth retaining member, and a second set of one or more expanding linkage assemblies. The third retaining member is rigidly coupled to another portion of the first longitudinal body. The fourth retaining member is movably coupled to the first longitudinal body. Each of the one or more expanding linkage assemblies of the second set of one or more expanding linkage assemblies includes a first linkage member and a second linkage member. The first linkage member has a first portion and a second portion opposite and spaced apart from the first portion. The first portion of the first linkage member is rotatably coupled to the first retaining member. The second linkage member has a third portion and a fourth portion opposite and spaced apart from the third portion. The fourth portion of the second linkage member is rotatably coupled to the second retaining member. The third portion of the second linkage member is rotatably coupled to the second portion of the first linkage member. The second set of one or more expanding linkage assemblies is movable between a collapsed configuration and an expanded configuration. The second retaining member is closer to the first retaining member and the third portion of the second linkage member is further from the central axis in the expanded configuration than in the collapsed configuration. The method further includes causing the second set of one or more expanding linkage assemblies to move from the collapsed configuration to the expanded configuration.

In some implementations, the second retaining member is disposed closer to the third retaining member than to the fourth retaining member, and the second retaining member is axially spaced apart from the third retaining member.

In some implementations, the one or more expanding linkage assemblies includes two or more expanding linkage assemblies. In some implementations, the two or more expanding linkage assemblies includes three or more expanding linkage assemblies. In some implementations, the two or more expanding linkage assemblies includes six or more expanding linkage assemblies.

In some implementations, the first longitudinal body comprises metal.

In some implementations, the first longitudinal body can withstand at least a 5,000-pound tensile load. In some implementations, the first longitudinal body can withstand at least a 5,000-pound compressive load.

BRIEF DESCRIPTION OF DRAWINGS

Example features and implementations are disclosed in the accompanying drawings. However, the present disclosure is not limited to the precise arrangements and instrumentalities shown.

DETAILED DESCRIPTION

Figure 1A:
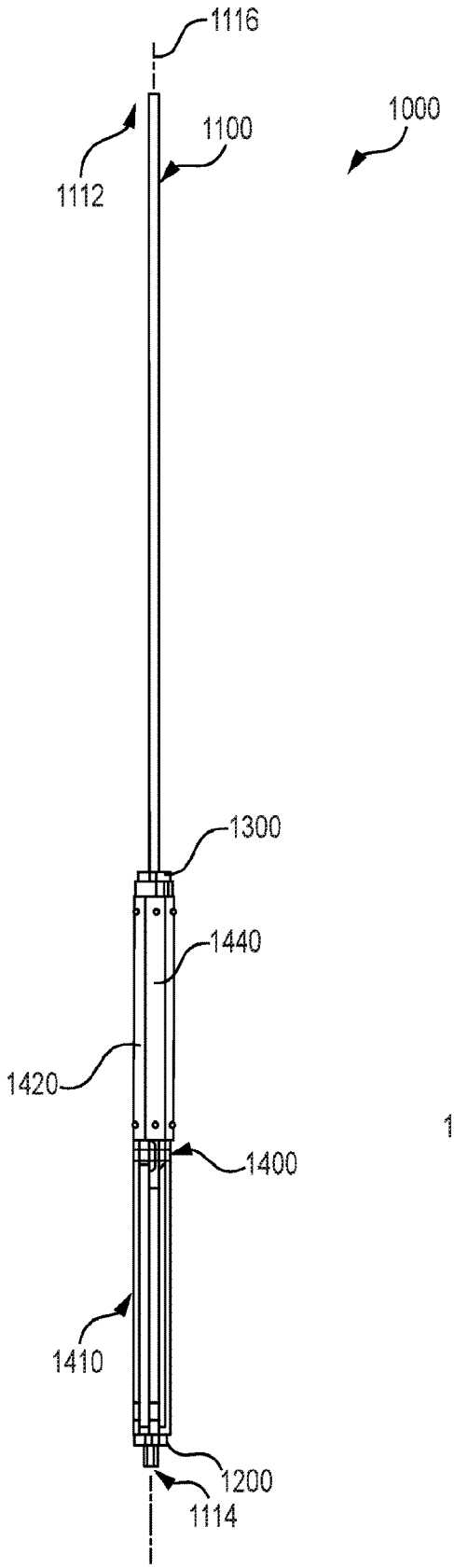
FIG. 1A is a side view of a ground anchoring apparatus in a collapsed configuration, according to one implementation.

Various implementations of the devices, systems, and methods described herein include a root-inspired ground anchor or deep foundation element capable of being expanded (increasing the spatial volume occupied by the anchor) from the exposed end once in the ground. The critical shear surface geometry of the root-inspired ground anchor is roughly log-spiral in shape.

Compared to the cylindrical critical shear surface geometry of a linear ground anchor, this change in geometry increases the surface area over which the shear strength of the geomaterial is mobilized and thereby increases the capacity of the anchor.

The change in critical shear surface geometry is a result of several things: the shape of the root-inspired ground anchor, the increased interparticle stresses in the geomaterial adjacent to the ground anchor, and the stress arching that exists between the expanded components of the anchor.

During installation, the root-inspired ground anchor is expanded to occupy a greater volume than the equivalent linear anchor. This expansion changes the geometry of the ground anchor, and both densifies the adjacent geomaterial, and increases the interparticle stresses within that geomaterial. During both installation and loading, interparticle stresses in the adjacent geomaterial increase along and in between each expansive anchor component. The increased interparticle stress between the expansive components is the phenomena known as stress arching. The leveraging of stress arching is critical to the material efficiency of the root-inspired ground anchor.

In the same way as for ground anchors installed as part of retaining structures, root-inspired ground anchors installed as foundation elements change the critical shear surface geometry in the surrounding geomaterial.

Various implementations include a ground anchoring apparatus. The ground anchoring apparatus include a first longitudinal body, a first retaining member, a second retaining member, and a first set of one or more expanding linkage assemblies. The first longitudinal body has a central axis. The first retaining member (e.g., collar, wall of the stressing element) is rigidly coupled to a portion of the first longitudinal body. The second retaining member is movably coupled (e.g., slidably coupled) to the first longitudinal body. Each of the one or more expanding linkage assemblies of the first set of one or more expanding linkage assemblies includes a first linkage member and a second linkage member. The first linkage member has a first portion and a second portion opposite and spaced apart from the first portion. The first portion of the first linkage member is rotatably coupled to the first retaining member. The second linkage member has a third portion and a fourth portion opposite and spaced apart from the third portion. The fourth portion of the second linkage member is rotatably coupled to the second retaining member. The third portion of the second linkage member is rotatably coupled to the second portion of the first linkage member. The first set of one or more expanding linkage assemblies is movable between a collapsed configuration and an expanded configuration. The second retaining member is closer to the first retaining member and the third portion of the second linkage member is further from the central axis in the expanded configuration than in the collapsed configuration.

Various implementations include a method of using a ground anchoring apparatus. The method includes disposing a ground anchoring apparatus within a ground opening, disposing a backfill within the ground opening, and causing the first set of one or more expanding linkage assemblies to move from the collapsed configuration to the expanded configuration.

FIGS. 1A-5B show a ground anchoring apparatus 1000, according to one implementation. FIG. 1A shows the ground anchoring apparatus 1000 in a collapsed configuration, and FIG. 1B shows the ground anchoring apparatus 1000 in an expanded configuration. The ground anchoring apparatus 1000 includes a first longitudinal body 1100, a first retaining member 1200, a second retaining member 1300, and a first set of six expanding linkage assemblies 1400.

Figure 1B:
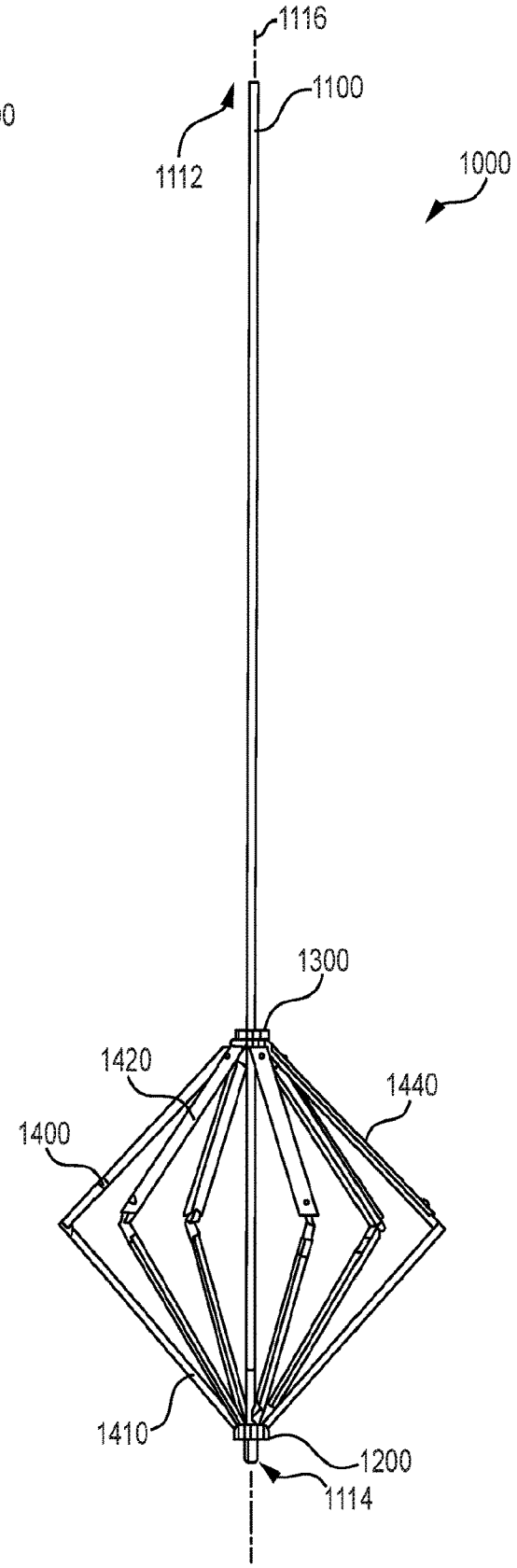
FIG. 1B is a side view of the ground anchoring apparatus of FIG. 1A in an expanded configuration.
Figure 2:
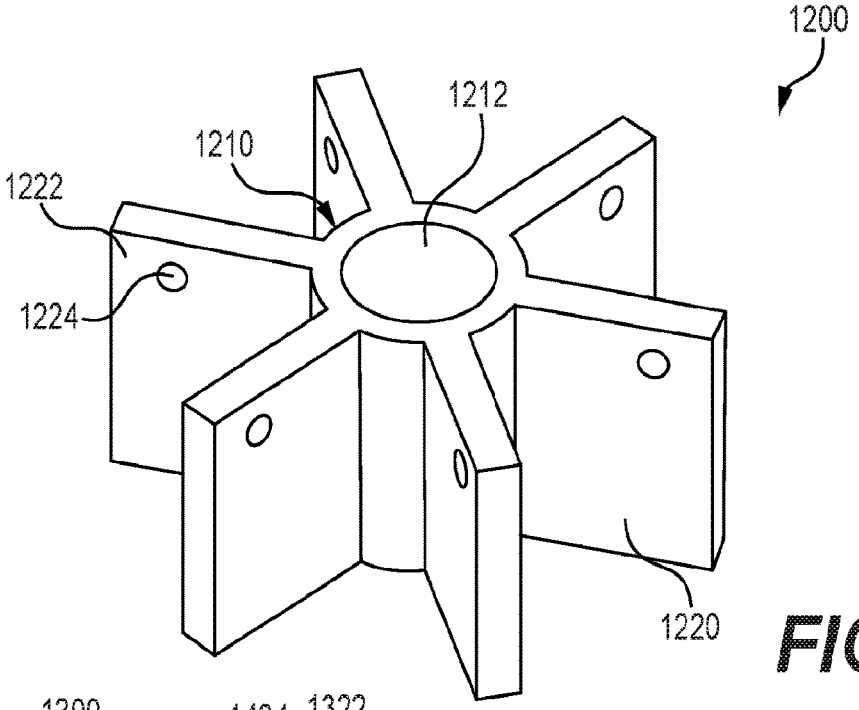
FIG. 2 is a detail perspective view of a first retaining member of the ground anchoring apparatus of FIG. 1A.

The first longitudinal body 1100 has a proximal end 1112, a distal end 1114 opposite and spaced apart from the proximal end 1112, and a central axis 1116 extending from the proximal end 1112 to the distal end 1114. The first longitudinal body 1100 shown in FIGS. 1A and 1B is made from steel, but in other implementations, the first longitudinal body is made of aluminum or any other metal. In some implementations, the first longitudinal body is made of a polymer, a fiber-reinforced polymer, a composite, a fiber-reinforced composite, fiberglass, bamboo, or any other material capable of withstanding any desired tensile or compressive load. For example, in some implementations, the first longitudinal body can withstand at least a 5,000-pound tensile load. In some implementations, the first longitudinal body can withstand at least a 5,000-pound compressive load. In some implementations, the first longitudinal body can withstand both tensile and compressive loads. In some implementations, the first longitudinal body includes a coating, such as a metallic or polymeric corrosion protection coating. Other loads may be applicable, e.g., between 1,000 pounds and 5,000 pounds, between 5,000 pounds and 50,000 pounds, between 50,000 pounds and 100,000 pounds, between 100,000 pounds and 200,000 pounds, between 200,000 pounds and 500,000 pounds, between 500,000 pounds and 1,000,000 pounds, or any load greater than 1,000 pounds.

In some embodiments, first longitudinal body 1100 has a length between 3 feet and 5 feet. In some embodiments, first longitudinal body 1100 has a length between 5 feet and 10 feet. In some embodiments, first longitudinal body 1100 has a length between 10 feet and 20 feet. In some embodiments, first longitudinal body 1100 has a length between 20 feet and 30 feet. In some embodiments, first longitudinal body 1100 has a length between 30 feet and 50 feet. In some embodiments, first longitudinal body 1100 has a length between 50 feet and 100 feet. In some embodiments, first longitudinal body 1100 has a length between 100 feet and 150 feet. In some embodiments, first longitudinal body 1100 has a length between 150 feet and 200 feet. In some embodiments, first longitudinal body 1100 has a length between 200 feet and 500 feet.

The first retaining member 1200 and second retaining member 1300 each include an annular body 1210, 1310 and six flanges 1220, 1320. An example of the first retaining member 1200 is shown in detail in FIG. 2, which is similar to the second retaining member 1300. The annular body 1210, 1310 of each of the first retaining member 1200 and the second retaining member 1300 defines an opening 1212, 1312 sized such that the first longitudinal body 1100 is disposed within the opening 1212, 1312. The annular body 1210 of the first retaining member 1200 is rigidly coupled to a portion of the first longitudinal body 1100 adjacent the distal end 1114 of the longitudinal body 1100 such that the first retaining member 1200 cannot move axially along the central axis 1116 of the first longitudinal body 1100. The annular body 1310 of the second retaining member 1300 is movably coupled to the first longitudinal body 1100 such that the second retaining member 1300 is axially slidable along the central axis 1116 of the first longitudinal body 1100.

Each of the six flanges 1220, 1320 of the first and second retaining members 1200, 1300 extends radially from the annular body 1210, 1310 and is spaced circumferentially around an outer surface of the annular body 1210, 1310. Each flange 1220 of the first retaining member 1200 includes a first hinge portion 1222, which includes a hinge opening 1224 defined by the flange 1220. Similarly, each flange 1320 of the second retaining member 1300 includes a second hinge portion 1322, which includes a hinge opening 1324 defined by the flange 1320.

Figure 3:
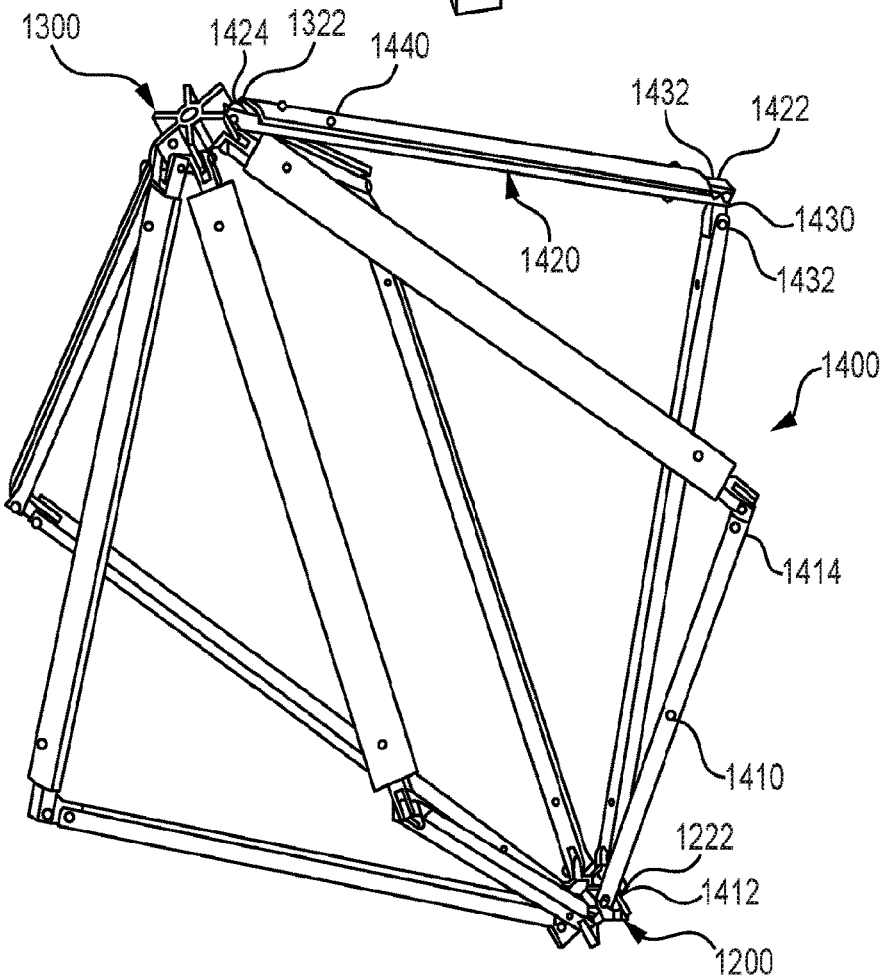
FIG. 3 is a detail perspective view of the set of expanding linkage assemblies of the ground anchoring apparatus of FIG. 1A.

FIG. 3 shows the set of six linkage assemblies 1400 coupled to the first and second retaining members 1200, 1300. Each of the six linkage assemblies 1400 of the first set of linkage assemblies includes a first linkage member 1410 and a second linkage member 1420. The first linkage member 1410 has a first portion 1412 and a second portion 1414 opposite and spaced apart from the first portion 1412, and the second linkage member 1420 has a third portion 1422 and a fourth portion 1424 opposite and spaced apart from the third portion 1422.

Figure 4:
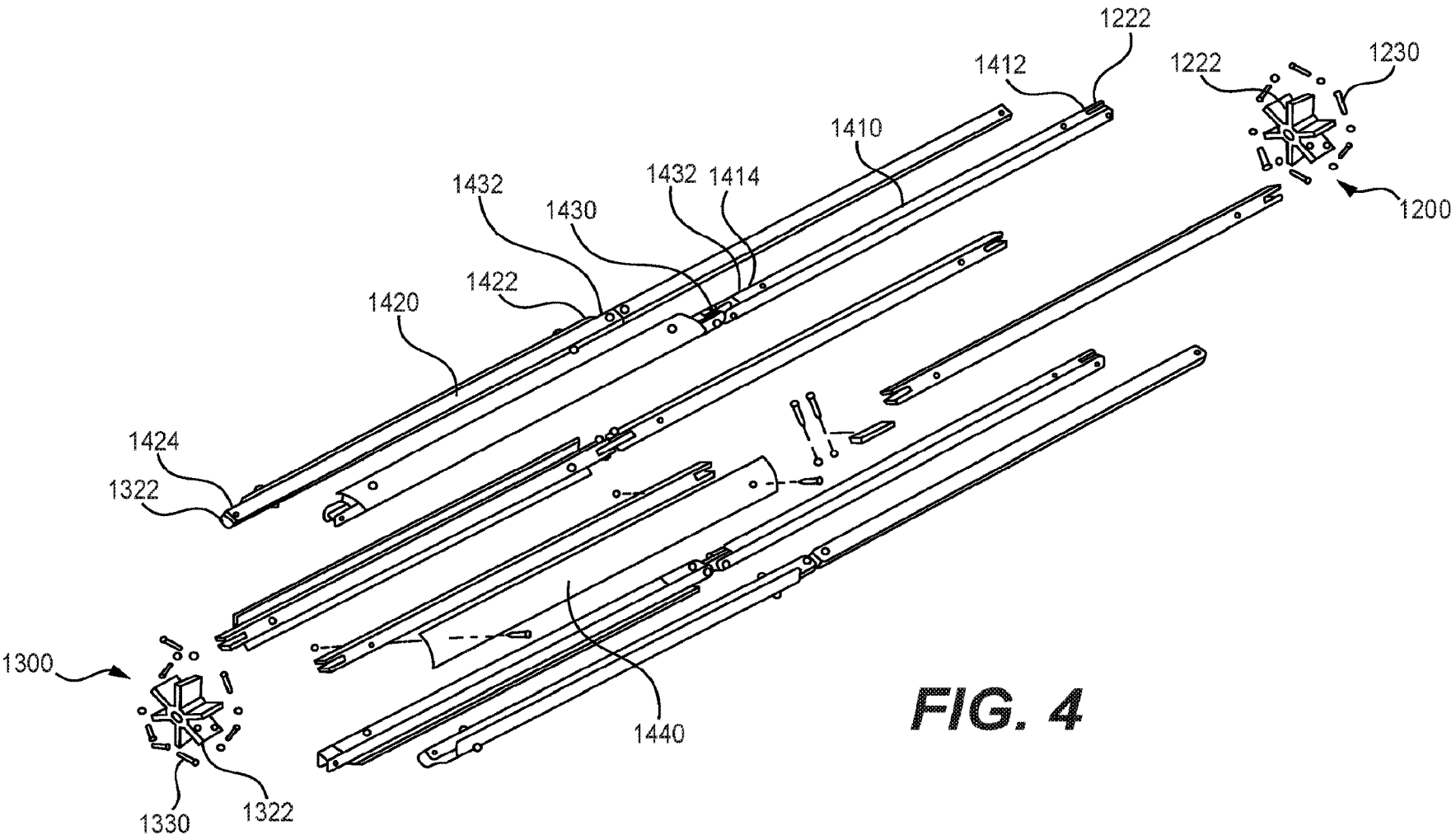
FIG. 4 is an exploded view of the set of expanding linkage assemblies of FIG. 3.

FIG. 4 shows an exploded view of the six linkage assemblies 1400 coupled to the first and second retaining members 1200, 1300. The first portion 1412 of the first linkage member 1410 includes a first hinge portion 1222 that is rotatably coupled to the first hinge portion 1222 of one of the flanges 1220 of the first retaining member 1200. Similarly, the fourth portion 1424 of the second linkage member 1420 includes a second hinge portion 1322 that is rotatably coupled to the second hinge portion 1322 of one of the flanges 1320 of the second retaining member 1300. Each of the sets of first and second hinge portions 1222, 1322 are rotatably coupled to each other by a pin 1230, 1330 that extends through the aligned hinge openings 1224, 1324 in the set of hinge portions 1222, 1322.

The third portion 1422 of the second linkage member 1420 and the second portion 1414 of the first linkage member 1410 each include a third hinge portion 1432. The third portion 1422 of the second linkage member 1420 and the second portion 1414 of the first linkage member 1410 are rotatably coupled to a hinge linkage 1430 by pins 1434 that extend through the aligned hinge openings 1224, 1324 in the set of hinge portions 1432.

The first set of expanding linkage assemblies 1400 is movable between a collapsed configuration (shown in FIGS. 1A and 5A) and an expanded configuration (FIGS. 1B and 5B) by axially sliding the second retaining member 1300 toward the first retaining member 1200. As the distance between the second retaining member 1300 and the first retaining member 1200 decreases, second retaining member 1300 causes each of the six linkage assemblies 1400 of the first set of linkage assemblies 1400 to hinge or rotate at the first, second, and third hinges 1222, 1322, 1432 such that the third portion 1422 of the second linkage 1420 assembly moves radially outwardly. Thus, when the first set of expanding linkage assemblies 1400 is in the expanded configuration, the second retaining member 1300 is closer to the first retaining member 1200 and the third portion 1422 of the second linkage member 1420 is further from the central axis 1116.

As shown in FIGS. 3 and 4, the hinge openings 1224 defined by the flanges 1220 of the first retaining member 1200 are disposed further radially outward than the hinge openings 1324 defined by the flanges 1324 of the second retaining member 1300. Thus, the rotation point of the first hinge portions 1222 are disposed further radially outwardly than the rotation point of the second hinge portions 1322. Also, the first linkage member 1410 has a length as measured from the first portion 1412 to the second portion 1414, and the second linkage member 1420 has a length as measured from the third portion 1422 to the fourth portion 1424. The lengths of the second linkage members 1420 are longer than the lengths of the first linkage members 1410 such that, in the collapsed configuration, the first linkage members 1410 are closer to parallel with the central axis 1116 than the second linkage members 1420. The further disposed first hinge points and the shorter lengths of the first linkage members 1410 ensures that the third hinge portions 1422 of the second linkage members 1420 are slightly bent radially outwardly in the collapsed configuration. Thus, when the second retaining member 1300 is moved toward the first retaining member 1200, the third portion 1422 of the second linkage member 1420 will move radially outwardly (toward the expanded configuration) rather than radially inwardly.

Because this configuration allows one of the linkage members to be substantially parallel to the central axis 1116 of the first longitudinal body 1100 in the collapsed configuration, the ground anchoring apparatus 1000 is at an optimal minimum collapsed size as measured in a plane perpendicular to the central axis 1116 and maximizes the useful length of the linkage members 1410, 1420. Furthermore, the relative lengths of the first and second linkage members 1410, 1420 and the relative radial distances of the hinge portions 1222, 1322 from the central axis 1116 still allows the first and second linkage members 1410, 1420 to form a ninety-degree angle when in the expanded configuration, which is ideal for structural stiffness. However, the relative lengths of the first and second linkage members 1410, 1420 and the relative radial distances of the hinge portions 1222, 1322 from the central axis 1116 can be altered to produce any desired angle between the first and second linkage members 1410, 1420.

Although the ground anchoring apparatus 1000 shown in FIGS. 1A-5B include both different relative lengths of the first and second linkage members 1410, 1420 and different relative radial distances of the hinge portions 1222, 1322 from the central axis 1116, in some implementations, the ground anchoring apparatus could include either different relative lengths of the first and second linkage members or different relative radial distances of the hinge portions from the central axis or neither.

Figure 6A:
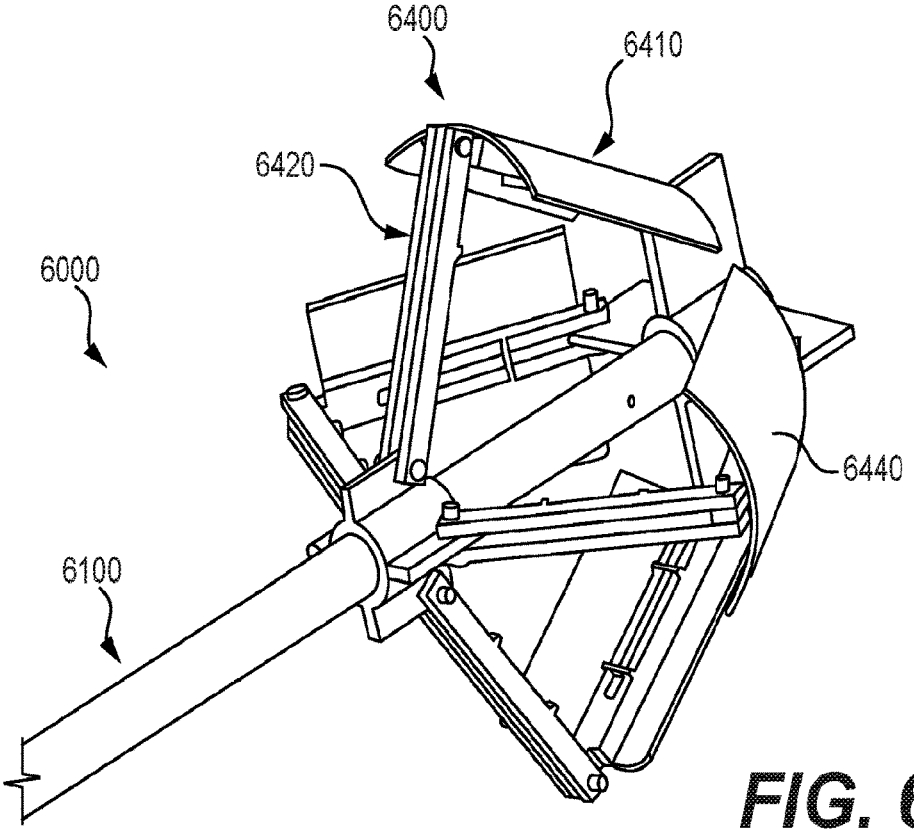
FIG. 6A is a perspective view of a ground anchoring apparatus, according to another implementation.
Figure 6B:
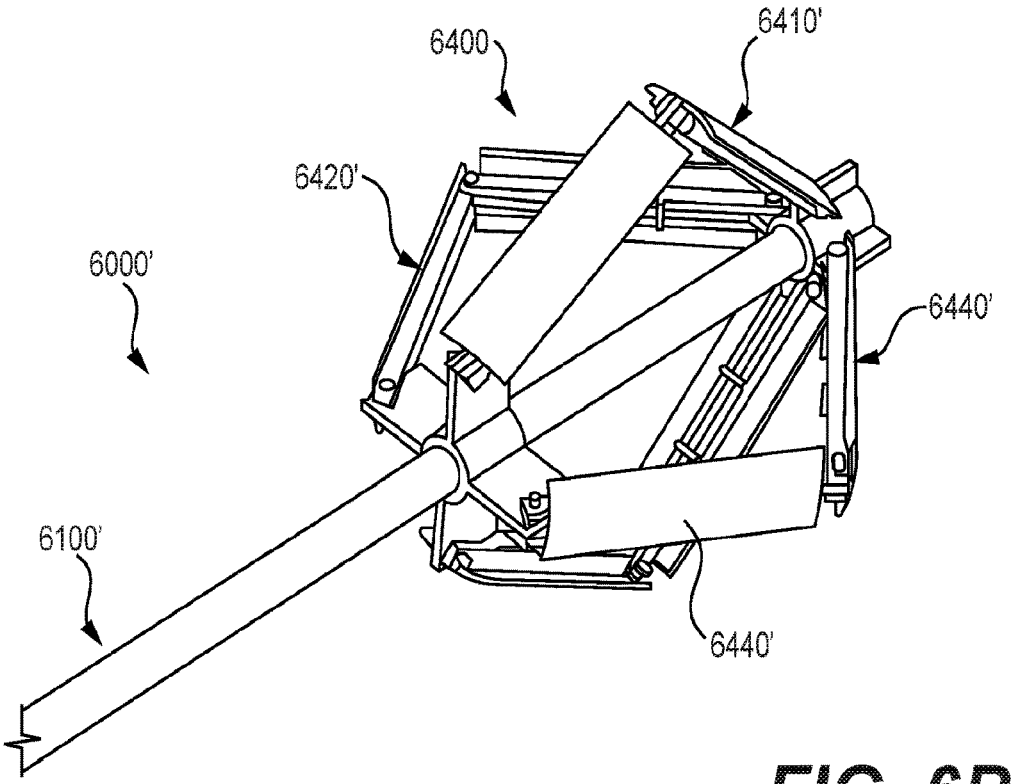
FIG. 6B is a perspective view of a ground anchoring apparatus, according to another implementation.

In some implementations, the hinge openings defined by the flanges of the second retaining member are disposed further radially outward than the hinge openings defined by the flanges of the first retaining member. For example, FIG. 6B shows a ground anchoring apparatus 6000 configured to withstand both tensile and compressive loads. The lengths of each of the first linkage members 6410 of the ground anchoring apparatus 6000 shown in FIG. 6A are also longer than the lengths of each of the second linkage members 6420 such that, in the collapsed configuration, the second linkage members 6420 are closer to parallel with the central axis 6116 than the first linkage members 6410.

Figure 7:
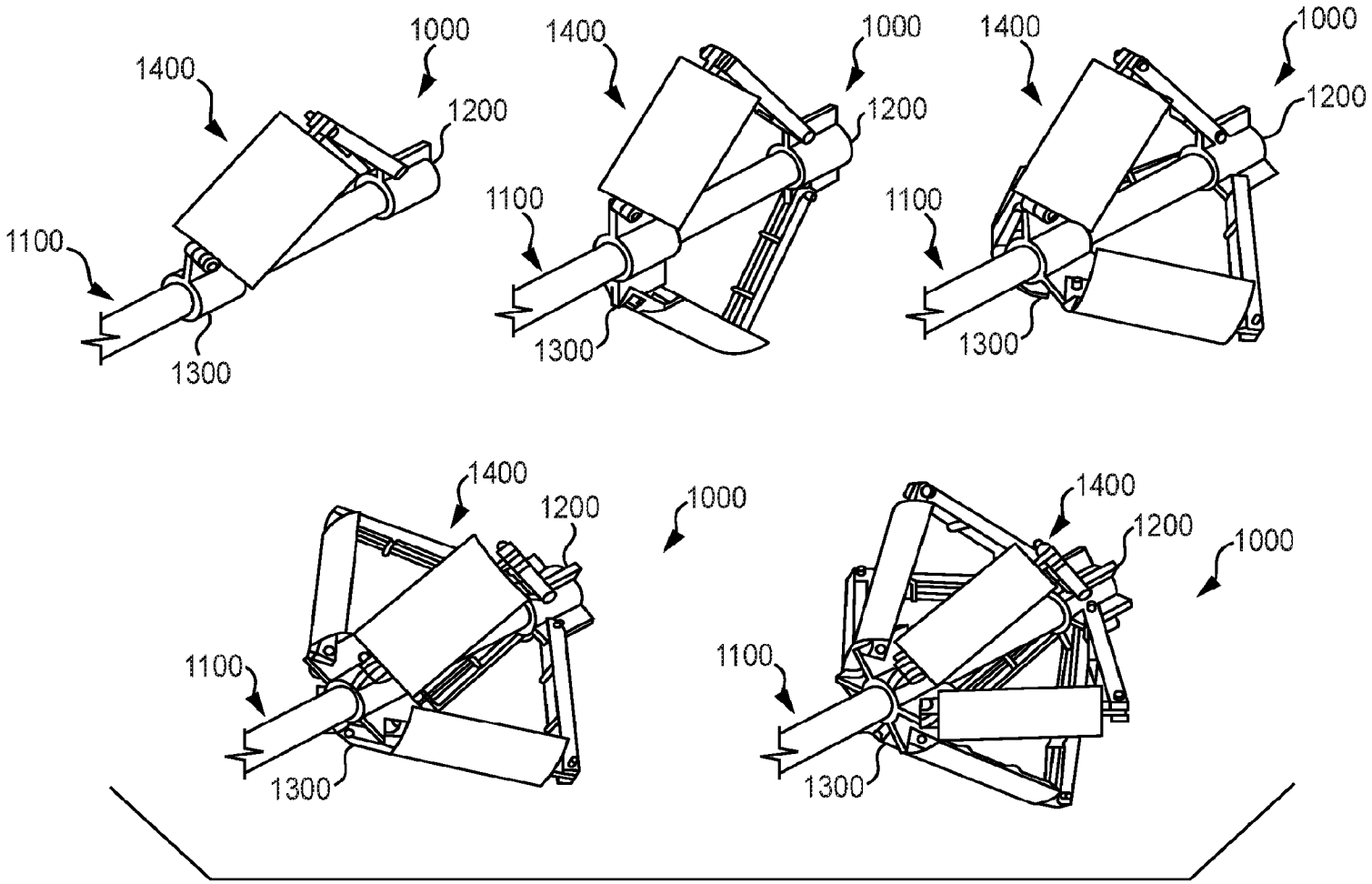
FIG. 7 are perspective views of five ground anchoring apparatus, according to other implementations.

Although the first set of expanding linkage assemblies 1400 shown in FIGS. 1A-5B includes six expanding linkage assemblies 1400, in some implementations, such as the implementations shown in FIG. 7, the first set of expanding linkage assemblies can include one or more expanding linkage assemblies. For example, in some implementations, the first set of expanding linkage assemblies can include two or more expanding linkage assemblies, three or more expanding linkage assemblies, six or more expanding linkage assemblies or any other number of expanding linkage assemblies.

Each of the second linkage members 1420 of the ground anchoring apparatus 1000 shown in FIGS. 1A-5B also include a linkage cover 1440. Each of the six linkage covers 1440 is coupled to one of the six second linkage members 1420 such that each linkage cover 1440 covers a radially outwardly facing surface of the respective second linkage member 1420 when the ground anchoring apparatus 1000 is in the collapsed configuration. Each of the linkage covers 1440 has a width that is greater than the width of the second linkage member 1420.

The linkage covers 1440 shown in FIGS. 1A-5B cover each of the second linkage members 1420 because the ground anchoring apparatus 1000 shown in FIGS. 1A-5B is configured for tensile loading. When a tensile load is applied to the first longitudinal body 1100 of the ground anchoring apparatus 1000 in the expanded configuration, the load is transferred to the second linkage members 1420 abutting the ground opening 1922 and/or backfill 1930. The linkage covers 1440 provide a greater surface area for the second linkage members 1420 as the second linkage members 1420 abut the ground opening 1922 and/or backfill 1930, as discussed further below. In other implementations, such as the implementation shown in FIG. 6A in which the ground anchoring apparatus 6000 is configured for compressive loading, the linkage covers 6440 can be coupled to and cover a radially outwardly facing surface of each of the first linkage members 6410. Similar to the tensile loading configuration, the compressive load is applied to the first longitudinal body 6100 of the ground anchoring apparatus 6000 when in the expanded configuration, which is then transferred to the first linkage members 6410 abutting the ground opening 6922 and/or backfill 6930. However, in some implementations, like the implementation shown in FIG. 6B, the ground anchoring apparatus 6000' can include linkage covers 6440' on both the first and second linkage members 6410', 6420'. In some implementations, the ground anchoring apparatus can include linkage covers on only a portion of the first and/or second linkage members. In some implementations, the ground anchoring apparatus does not include linkage covers.

The second retaining member 1300 of the ground anchoring apparatus 1000 shown in FIGS. 1A and 1B also includes a lock 1500 for preventing the first set of one or more expanding linkage assemblies 1400 from moving from the expanded configuration to the collapsed configuration. The lock 1500 includes a barb 1510 that is biased radially inwardly by a spring force and is urgable radially outwardly. The first longitudinal body 1100 includes a notch 1520 at the portion of the first longitudinal body 1100 at which the second retaining member 1300 is disposed when the ground anchoring apparatus 1000 is in the expanded configuration, and the barb 1510 of the lock 1500 engages the notch 1520 in the expanded configuration to prevent the second retaining member 1300 from axially moving.

Figures 8A, 8B:
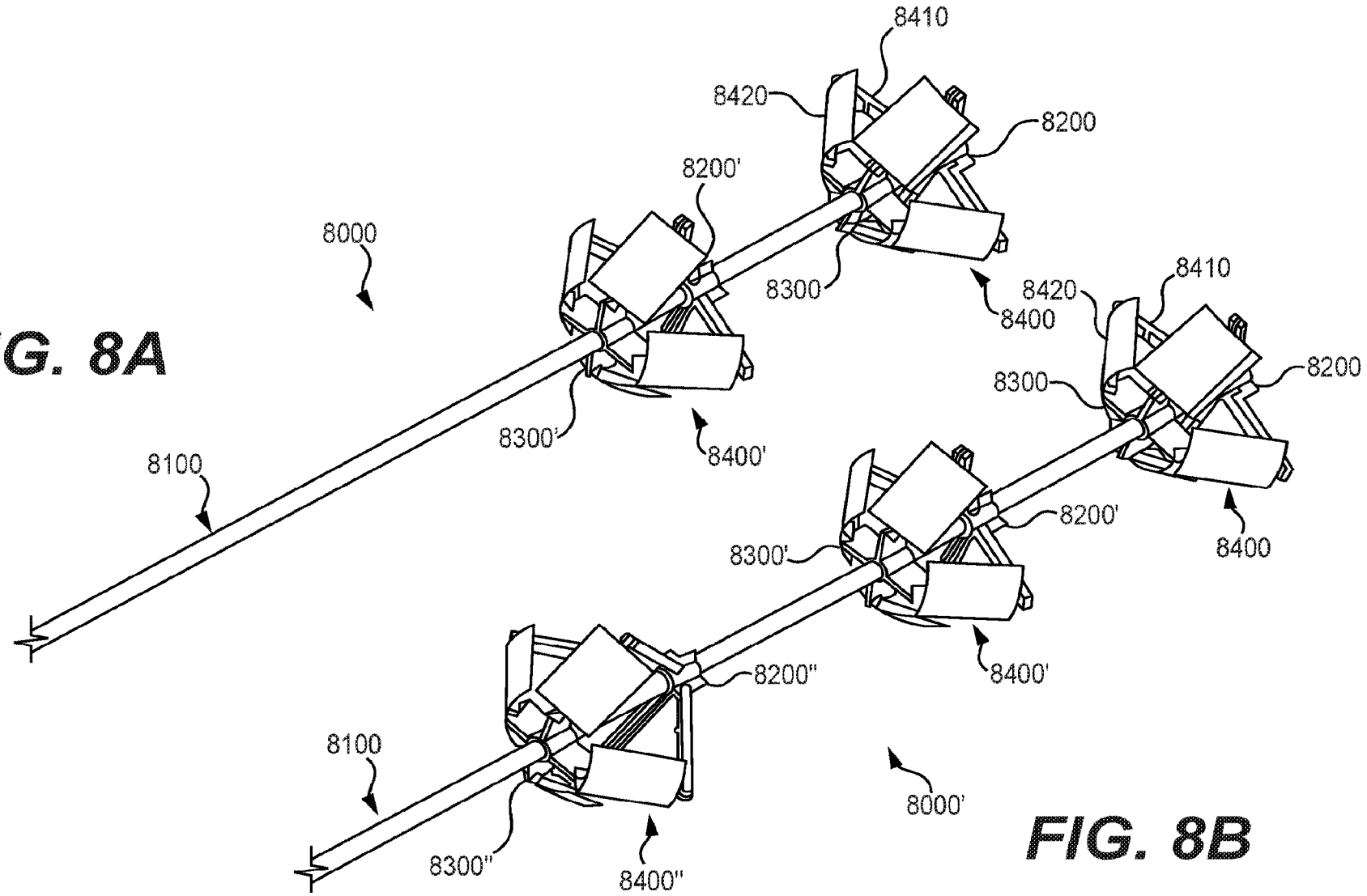
FIG. 8A is a perspective view of a ground anchoring apparatus, according to another implementation.
FIG. 8B is a perspective view of a ground anchoring apparatus, according to another implementation.

FIGS. 8A and 8B show ground anchoring apparatus 8000, 8000' according to other implementations. Because the implementations shown in FIGS. 8A and 8B are similar to the implementation shown in FIGS. 1A-5B, similar reference numbers as those used in FIGS. 1A-5B are used to refer to similar features in FIGS. 8A and 8B. Similar to the ground anchoring apparatus 1000 shown in FIGS. 1A-5B, the ground anchoring apparatus 8000, 8000' shown in FIGS. 8A and 8B include a first longitudinal body 8100, first and second retaining members 8200, 8300, and a first set of expanding linkage assemblies 8400. However, the ground anchoring apparatus 8000 shown in FIG. 8A further includes a third retaining member 8200', a second retaining member 8300', and a second set of four expanding linkage assemblies 8400'. FIG. 8B further includes a fifth retaining member 8200", a sixth retaining member 8300", and a third set of expanding linkage assemblies 8400". The first and second linkage members 8410', 8420' of the second set of expandable linkage assemblies 8400' in FIG. 8A are coupled to the third and fourth retaining members 8200', 8300' in the same way as the first and second linkage members 8410, 8420 of the first set of expandable linkage assemblies 8400 are coupled to the first and second retaining members 8200, 8300. The second retaining member 8300 is disposed closer to the third retaining member 8200' than to the fourth retaining member 8300' such that the second retaining member 8300 is axially spaced apart from the third retaining member 8200'. The second set of expandable linkage assemblies 8400' is also movable between a collapsed configuration and an expanded configuration similar to the first set of expandable linkage assemblies 8400.

Figure 5A:
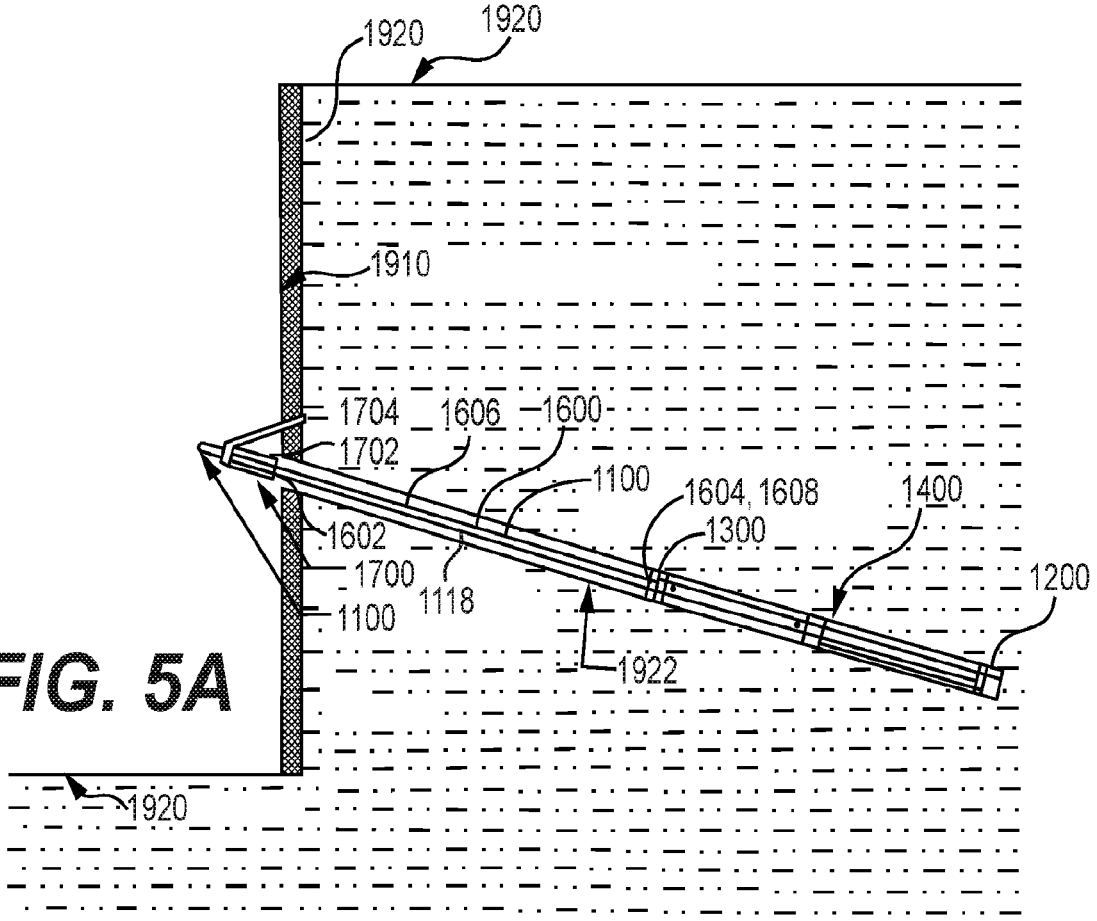
FIG. 5A is a side view of the ground anchoring apparatus of FIG. 1A in a ground opening in the collapsed configuration.
Figure 5B:
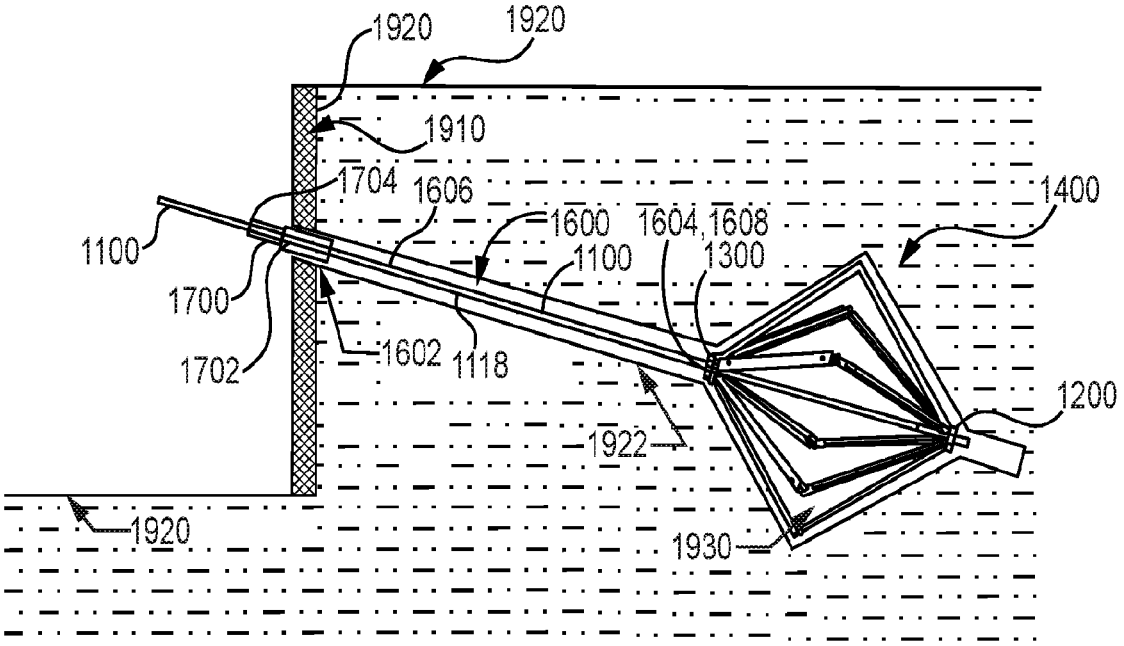
FIG. 5B is a side view of the ground anchoring apparatus of FIG. 1A in a ground opening in the expanded configuration.

FIGS. 5A and 5B show the ground anchoring apparatus 1000 further including a second longitudinal body 1600, a jack 1700, and a resistance plate 1704.

The second longitudinal body 1600 shown in FIGS. 5A and 5B is a hollow casing that has a proximal end 1602 and a distal end 1604 opposite and axially spaced apart from the proximal end 1602. The proximal end 1602 of the second longitudinal body 1600 defines a central bore 1606 extending to the distal end 1604, and the distal end 1604 includes an engagement surface 1608. The central bore 1606 is sized such that the first longitudinal body 1100 is slidingly disposed within the central bore 1606, as shown in FIGS. 5A and 5B, such that the second longitudinal body 1600 is slidable along the central axis 1116 and the engagement surface 1608 abuts the second retaining member 1300.

The jack 1700 is disposed adjacent the proximal end 1602 of the second longitudinal body 1600 with the resistance plate 1704. The resistance plate 1704 is rigidly coupled to the first longitudinal body 1100 adjacent the proximal end 1112. When the jack 1700 is activated, the jack 1700 exerts a force on the resistance plate 1704 and the second longitudinal body 1600 to cause the second longitudinal body 1600 to move toward the first retaining member 1200. The force exerted on the second longitudinal body 1600 by the jack 1700 is transferred to the abutted second retaining member 1300 which causes the second retaining member 1300 to move from the collapsed configuration to toward the expanded configuration.

In some implementations, such as the ground anchoring apparatus 1000 shown in FIGS. 5A and 5B, the first longitudinal body 1100 includes an outer threaded portion 1118 and the jack 1700 includes an inner threaded portion 1702. The inner threaded 1702 portion of the jack 1700 engages the outer threaded portion 1118 of the first longitudinal body 1100 such that rotation of the inner threaded portion 1702 of the jack 1700 about the central axis 1116 causes the jack 1700 to move axially along the first longitudinal body 1100. However, in other implementations, the jack can be any type of jack known in the art.

Figures 9A, 9B, 9C:
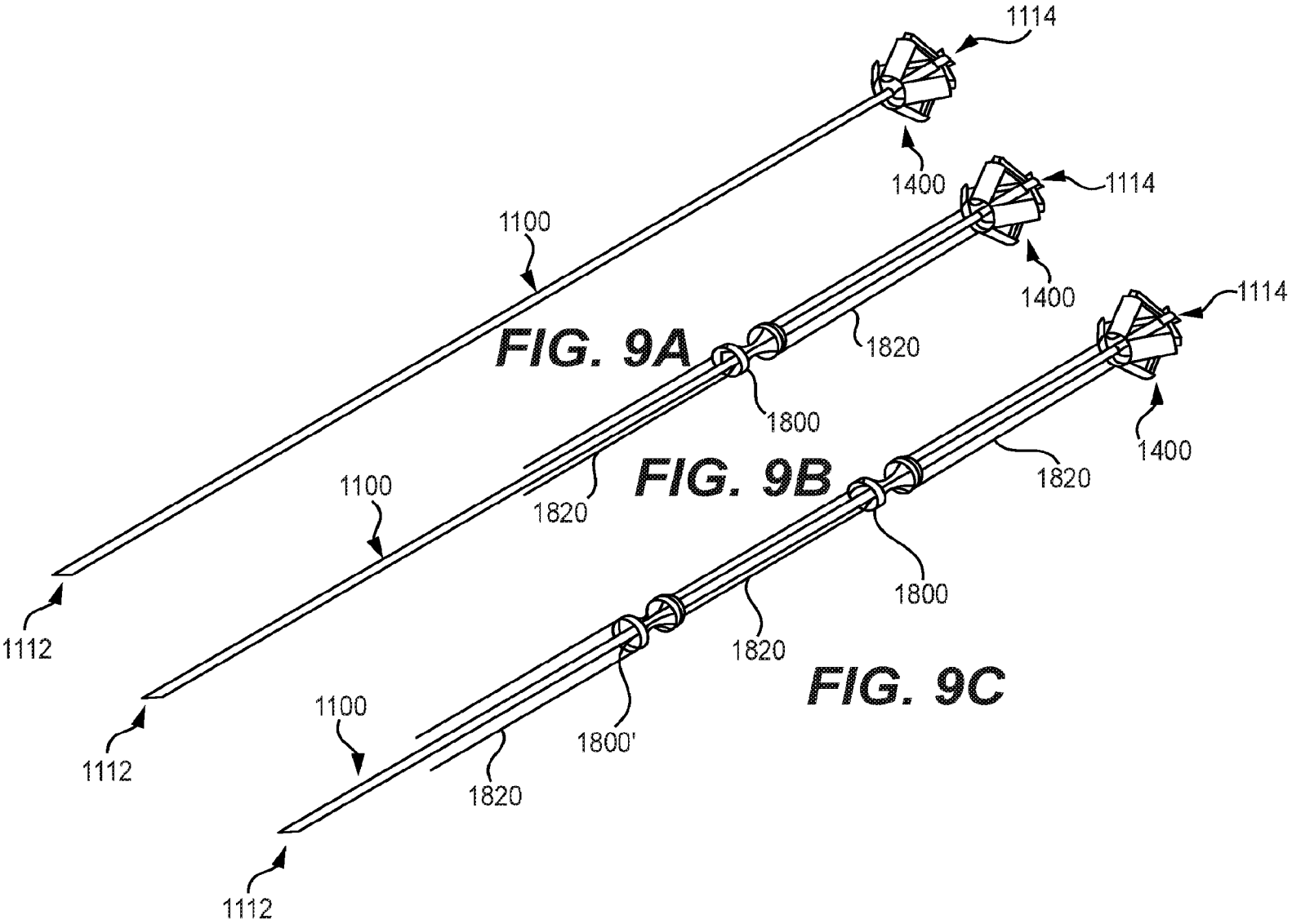
FIG. 9A is a perspective view of a ground anchoring apparatus without centralizers, according to another implementation.
FIG. 9B is a perspective view of a ground anchoring apparatus with one centralizer, according to another implementation.
FIG. 9C is a perspective view of a ground anchoring apparatus with two centralizers, according to another implementation.
Figure 10:
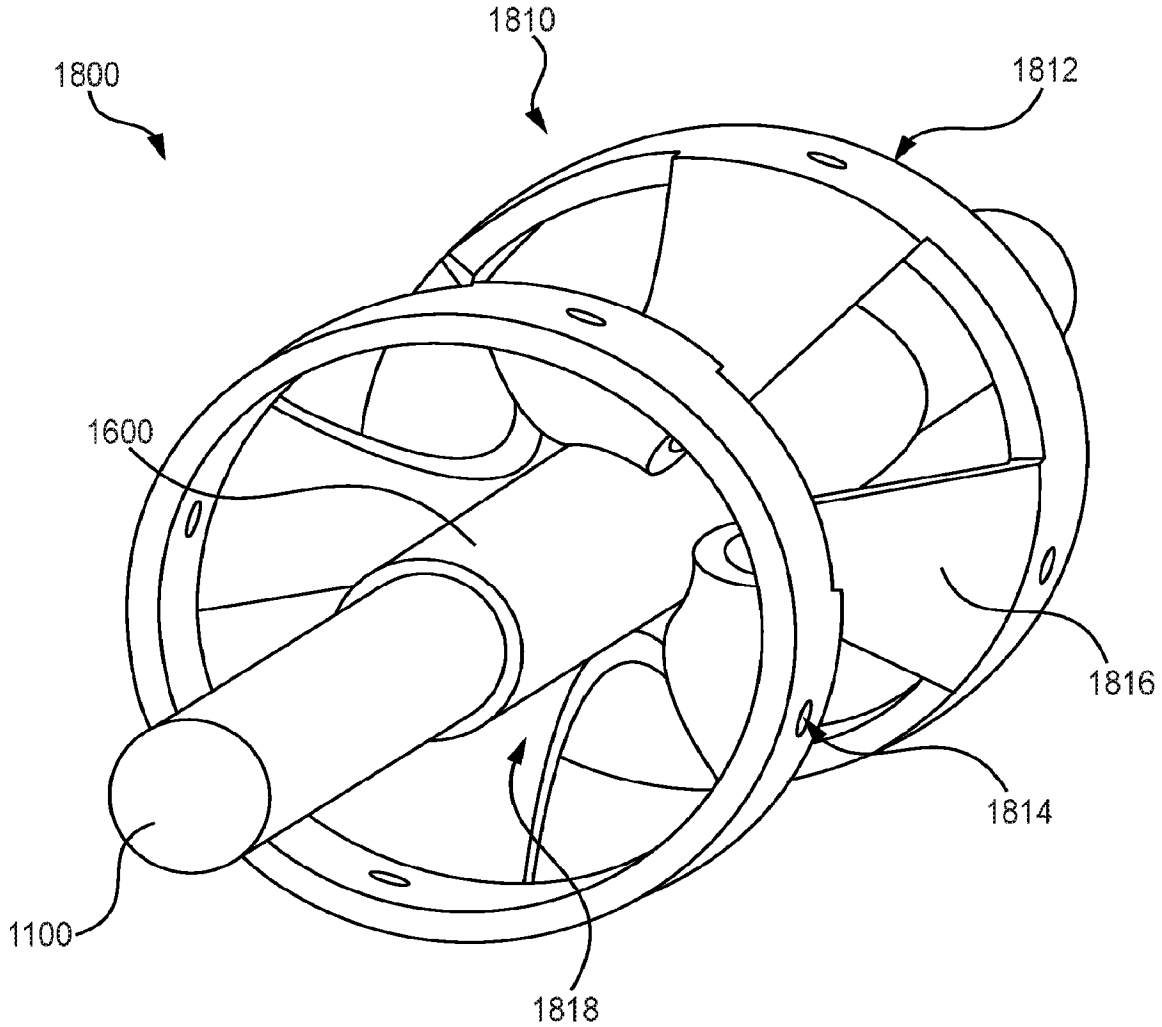
FIG. 10 is a detailed perspective view of a centralizer of FIGS. 9B and 9C.

As shown in FIGS. 9A-9C, the ground anchoring apparatus 1000 can further include one or more centralizers 1800 for maintaining the first longitudinal body 1100 toward the center of a ground opening 1922. FIG. 10 shows a detailed view of a centralizer. Each of the one or more centralizers 1800 includes a resilient body 1810 that includes a first body end 1812, a second body end 1814 opposite and spaced apart from the first body end 1812, and one or more resilient slats 1816 extending between the first body end 1812 and the second body end 1814. A portion of the one or more resilient slats 1816 at least partially define a centralizer opening 1818. Each of the resilient slats 1816 is biased toward a first centralizer position in which the centralizer opening 1818 has a first diameter and is urgable toward a second centralizer position in which the centralizer opening 1818 has a second diameter. The second diameter is greater than the first diameter such that the second longitudinal body 1600 is slidingly disposable within the centralizer opening 1818 when the resilient slats 1816 of the resilient body 1810 are in the second centralizer position and the first longitudinal body 1100 is slidingly disposable within the centralizer opening 1818 when the resilient slats 1816 are in the first centralizer position. Thus, when the second longitudinal body 1600 is slidingly removed from the first longitudinal body 1100, the centralizer openings 1818 of the one or more centralizers 1800 will adapt to the change in diameter. In some implementations, the centralizer has an outer diameter from 3 inches to 36 inches to fit within a ground opening having a corresponding diameter.

Each of the centralizers 1800 shown in FIGS. 9A-9C includes a plurality of tethers 1820. The first centralizer 1800 is tethered to the second retaining member 1300. In the implementation shown in FIG. 9C, the ground anchoring apparatus 1000 includes two centralizers 1800, 1800', and the second centralizer 1800' is tethered to the first centralizer 1800. The second centralizer 1800' is also tethered to a portion of the first longitudinal body 1100 between the second longitudinal body 1600 and the proximal end 1112 of the first longitudinal body 1100. In implementations with more than two centralizers, the centralizers are tethered in series with the first centralizer tethered to the second retaining member and the last centralizer in the series tethered to a portion of the first longitudinal body between the second longitudinal body and the proximal end of the first longitudinal body.

In some implementations, the first centralizer is tethered to the first retaining member or a portion of the first longitudinal body between the first retaining member and the distal end of the first longitudinal body. In some implementations, the last centralizer in the series of tethered centralizers is not tethered to the first longitudinal body. In some implementations, the last centralizer in the series of tethered centralizers is tethered to a weighted object to provide resistance to the centralizer. In some implementations, the ground anchoring apparatus includes no centralizers or any number of centralizers. In some implementations, the centralizer opening is not configured to resiliently move between a first centralizer position and a second centralizer position such that the diameter of the centralizer opening remains constant.

In use, a retaining structure 1910 or any other structure to be coupled to the ground is disposed adjacent a ground surface 1920, as shown in FIGS. 5A and 5B. A ground opening 1922 is formed through the structure 1910, through the ground surface 1920, and into the ground to a desired depth.

The second longitudinal body 1600 is slidingly disposed along the first longitudinal body 1100, and if centralizers 1800 are to be included with the ground anchoring apparatus 1000, then one or more centralizers 1800 are tethered to the ground anchoring apparatus 1000 with tethers 1820, as described above.

The ground anchoring apparatus 1000 in the collapsed configuration is then disposed within the ground opening 1922 such that the distal end 1114 of the first longitudinal body 1100 is disposed in the ground opening 1922. Once the ground anchoring apparatus 1000 is in place, a jack 1700 and resistance plate 1704 are coupled to the ground anchoring apparatus 1000, as discussed above. The jack 1700 is then activated to cause the ground anchoring apparatus 1000 to move from the collapsed configuration to the expanded configuration. The first and second linkages 1410, 1420 (and their associated linkage covers 1440) press against the ground within the ground opening 1922, moving the ground and enlarging the ground opening 1922 radially outwardly with respect to the central axis 1116.

Once the ground anchoring apparatus 1000 is in the expanded configuration, the lock 1500 engages to prevent the ground anchoring apparatus 1000 from moving from the expanded configuration back to the collapsed configuration.

The second longitudinal body 1600 and the jack 1700 are then removed from the ground anchoring apparatus 1000 such that the second longitudinal body 1600 and the jack 1700 can be reused on another ground anchoring apparatus 1000. A backfill material 1930 is then poured into the ground opening 1922 with the ground anchoring apparatus 1000. The backfill material 1930 can be any cement-based or non-cement-based material (e.g., bentonite slurry). The backfill material 1930 within the ground opening 1922 causes the linkage assemblies 1400 to become rigid and prevents the ground from collapsing into the ground opening 1922.

Although the backfill material 1930 is added after the ground anchoring apparatus 1000 is moved from the collapsed configuration to the expanded configuration in the method described above, in other implementations, the backfill is added first and then the ground anchoring apparatus is moved from the collapsed configuration to the expanded configuration. The order of the backfill material 1930 and actuating of the ground anchoring apparatus 1000 can be altered as desired based on ground conditions.

Although the ground anchoring apparatus 1000 shown in FIGS. 5A and 5B is being used to couple a retaining structure 1910 to a vertical ground surface 1920, in other implementations, the ground anchoring apparatus can be used to couple any structure to a horizontal ground surface or any other angle ground surface.

A number of implementations have been described. Nevertheless, it will be understood that various modifications may be made without departing from the spirit and scope of the claims. Accordingly, other implementations are within the scope of the following claims.

In some embodiments, the ground anchoring apparatus described herein is used for building support, civil engineering and other structures, either permanently or temporarily. Example of civil engineering structures include, but are not limited to, bridges, tunnels, roadways, aqueducts and viaducts, canals, towers, chimneys, dams, railways, retaining walls, tunnels, coastal defenses. Other examples includes support structure for wind turbines, seawalls. The ground anchoring described herein may be used to support ropes, cables, struts, columns, beams, arches, and various load bearing structures.

In some embodiments, the ground anchoring apparatus described herein is used for support for retaining walls, soldier pile wall, contiguous pile wall, sheet pile wall.

Certain terminology is used herein for convenience only and is not to be taken as a limitation on the present claims. In the drawings, the same reference numbers are employed for designating the same elements throughout the several figures. A number of examples are provided, nevertheless, it will be understood that various modifications can be made without departing from the spirit and scope of the disclosure herein. As used in the specification, and in the appended claims, the singular forms "a," "an," and "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A ground anchoring apparatus comprising:

a first longitudinal body having a central axis;

a first retaining member rigidly coupled to a portion of the first longitudinal body and comprising (i) a first annular body defining an opening sized such that the first longitudinal body is disposable within the opening and (ii) one or more flanges each extending radially outward from the first annular body, the one or more flanges each defining one or more hinge openings extending therethrough;

a second retaining member movably coupled to the first longitudinal body and comprising (i) a second annular body defining an opening sized such that the first longitudinal body is disposable within the opening and (ii) one or more flanges each extending radially outward from the second annular body, the one or more flanges each defining one or more hinge openings extending therethrough; and a first set of one or more expanding linkage assemblies, each of the one or more expanding linkage assemblies including:

a first linkage member having a first portion and a second portion opposite and spaced apart from the first portion, wherein the first portion of the first linkage member is rotatably coupled to the first retaining member via the one or more hinge openings of the first retaining member, and a second linkage member having a third portion and a fourth portion opposite and spaced apart from the third portion, wherein the fourth portion of the second linkage member is rotatably coupled to the second retaining member, and wherein the third portion of the second linkage member is rotatably coupled to the second portion of the first linkage member via the one or more hinge openings of the second retaining member, wherein the first set of one or more expanding linkage assemblies is movable between a collapsed configuration and an expanded configuration, wherein the second retaining member is closer to the first retaining member and the third portion of the second linkage member is further from the central axis in the expanded configuration than in the collapsed configuration, wherein the one or more hinge openings defined in one of the second retaining member and the first retaining member is disposed further radially outward from the central axis than the one or more hinge openings defined in the other of the first retaining member and the second retaining member.

2. The ground anchoring apparatus of claim 1, further comprising a second longitudinal body having an engagement surface that abuts the second retaining member to move the first set of one or more expanding linkage assemblies from the collapsed configuration to the expanded configuration.

3. The ground anchoring apparatus of claim 2, wherein the second longitudinal body has a proximal end and a distal end opposite and spaced apart from the proximal end, the proximal end of the second longitudinal body defining a central bore extending to the distal end, wherein the central bore is sized such that the first longitudinal body is slidingly disposable within the central bore.

4. The ground anchoring apparatus of claim 2, further comprising a jack for causing the second longitudinal body to move toward the first retaining member when the engagement surface of the second longitudinal body abuts the second retaining member.

5. The ground anchoring apparatus of claim 2, further comprising one or more centralizers configured to maintain the first longitudinal body towards a center of a ground opening, wherein each of the one or more centralizers includes a resilient body defining a centralizer opening sized to accept the first longitudinal body and the second longitudinal body, wherein the resilient body is biased toward a first centralizer position in which the centralizer opening has a first diameter and the resilient body is urgable toward a second centralizer position in which the centralizer opening has a second diameter, wherein the second diameter is greater than the first diameter.

6. The ground anchoring apparatus of claim 1, wherein the first longitudinal body has a proximal end and a distal end opposite and spaced apart from the proximal end, wherein the first retaining member is rigidly coupled adjacent the distal end of the first longitudinal body.

7. The ground anchoring apparatus of claim 1, wherein the first portion of the first linkage member is rotatably coupled to the first retaining member by a first hinge, and wherein the fourth portion of the second linkage member is rotatably coupled to the second retaining member by a second hinge.

8. The ground anchoring apparatus of claim 1, wherein each of the one or more second linkage members further includes a linkage cover coupled to the second linkage member, wherein the linkage cover has a width that is greater than a width of the second linkage member.

9. The ground anchoring apparatus of claim 1, wherein a rotation point of the first portion of the first linkage member is radially offset from a rotation point of the fourth portion of the second linkage member with respect to the central axis.

10. The ground anchoring apparatus of claim 1, wherein the first linkage member is rotatably coupled to the first retaining member via a pin extending through one or more hinge openings of the first retaining member.

11. The ground anchoring apparatus of claim 1, wherein the first linkage member has a first length as measured from the first portion to the second portion, and the second linkage member has a second length as measured from third portion to the fourth portion, wherein the second length is different than the first length such that, in the collapsed configuration, one of the first linkage member and the second linkage member is closer to parallel with the central axis than the other of the first linkage member and the second linkage member.

12. The ground anchoring apparatus of claim 1, wherein the third portion of the second linkage member is rotatably coupled to the second portion of the first linkage member via a hinge linkage, wherein, when moving from the collapsed configuration to the expanded configuration, the hinge linkage extends most prominently radially outward such that the hinge linkage and the portions of the linkage members attached thereto first abut a surrounding substrate.

13. The ground anchoring apparatus of claim 1, further comprising a lock which engages in the expanded configuration to prevent the ground anchoring apparatus from moving from the expanded configuration back to the collapsed configuration.

14. The ground anchoring apparatus of claim 13, wherein the lock comprises a barb that is biased radially inwardly by a spring force and is urgable radially outwardly, the first longitudinal body including a notch which engages the lock in the expanded configuration to prevent the second retaining member from axially moving.

15. The ground anchoring apparatus of claim 1, wherein the third portion of the second linkage member is adjacent to an end of the second linkage member, and the second portion of the first linkage member is adjacent to an end of the first linkage member, such that the end of the first linkage member is rotatably coupled to the end of the second linkage member.

16. A method of using a ground anchoring apparatus, the method comprising:

disposing a ground anchoring apparatus within a ground opening, the ground anchoring apparatus comprising:

a first longitudinal body having a central axis;

a first retaining member rigidly coupled to a portion of the first longitudinal body and comprising (i) a first annular body defining an opening sized such that the first longitudinal body is disposable within the opening and (ii) one or more flanges each extending radially outward from the first annular body, the one or more flanges each defining one or more hinge openings extending therethrough;

a second retaining member movably coupled to the first longitudinal body and comprising (i) a second annular body defining an opening sized such that the first longitudinal body is disposable within the opening and (ii) one or more flanges each extending radially outward from the second annular body, the one or more flanges each defining one or more hinge openings extending therethrough; and a first set of one or more expanding linkage assemblies, each of the one or more expanding linkage assemblies including:

a first linkage member having a first portion and a second portion opposite and spaced apart from the first portion, wherein the first portion of the first linkage member is rotatably coupled to the first retaining member via the one or more hinge openings of the first retaining member, and a second linkage member having a third portion and a fourth portion opposite and spaced apart from the third portion, wherein the fourth portion of the second linkage member is rotatably coupled to the second retaining member via the one or more hinge openings of the second retaining member, and wherein the third portion of the second linkage member is rotatably coupled to the second portion of the first linkage member, wherein the first set of one or more expanding linkage assemblies is movable between a collapsed configuration and an expanded configuration, wherein the second retaining member is closer to the first retaining member and the third portion of the second linkage member is further from the central axis in the expanded configuration than in the collapsed configuration, and wherein the one or more hinge openings defined in one of the second retaining member and the first retaining member is disposed further radially outward from the central axis than the one or more hinge openings defined in the other of the first retaining member and the second retaining member;

disposing a backfill within the ground opening; and causing the first set of one or more expanding linkage assemblies to move from the collapsed configuration to the expanded configuration.

17. The method of claim 16, further comprising forming the ground opening.

18. The method of claim 10, wherein the ground anchoring apparatus further comprises a second longitudinal body having an engagement surface, wherein causing the first set of one or more expanding linkage assemblies to move from the collapsed configuration to the expanded configuration includes disposing the second longitudinal body within the ground opening and abutting the engagement surface against the second retaining member and moving the first set of one or more expanding linkage assemblies from the collapsed configuration to the expanded configuration.

19. The method of claim 18, wherein the second longitudinal body has a proximal end and a distal end opposite and spaced apart from the proximal end, the proximal end of the second longitudinal body defining a central bore extending to the distal end, wherein the first longitudinal body is slidingly disposes within the central bore.

20. The method of claim 18, further comprising removing the second longitudinal body from the ground opening after causing the first set of one or more expanding linkage assemblies to move from the collapsed configuration to the expanded configuration.

21. The method of claim 18, wherein the ground anchoring apparatus further comprises a jack, wherein causing the first set of one or more expanding linkage assemblies to move from the collapsed configuration to the expanded configuration includes using the jack to cause the second longitudinal body to move toward the first retaining member when the engagement surface of the second longitudinal body is abutting the second retaining member.

22. The method of claim 18, wherein the ground anchoring apparatus further comprises one or more centralizers configured to maintain the first longitudinal body towards a center of a ground opening, wherein each of the one or more centralizers includes a resilient body defining a centralizer opening sized to accept the first longitudinal body and the second longitudinal body, wherein the first longitudinal body is disposed within the centralizer opening, wherein the resilient body is biased toward a first centralizer position in which the centralizer opening has a first diameter and the resilient body is urgable toward a second centralizer position in which the centralizer opening has a second diameter, wherein the second diameter is greater than the first diameter.

23. The method of claim 16, wherein the first longitudinal body has a proximal end and a distal end opposite and spaced apart from the proximal end, wherein the first retaining member is rigidly coupled adjacent the distal end of the first longitudinal body.

24. The method of claim 16, wherein the first portion of the first linkage member is rotatably coupled to the first retaining member by a first hinge, and wherein the fourth portion of the second linkage member is rotatably coupled to the second retaining member by a second hinge.

25. The method of claim 16, wherein each of the one or more second linkage members further include a linkage cover coupled to the second linkage member, wherein the linkage cover has a width that is greater than a width of the second linkage member.

26. The method of claim 16, further comprising: locking the ground anchoring apparatus in the expanded configuration via a lock comprising a barb that is biased radially inwardly by a spring force and is urgable radially outwardly, and a notch which engaged the lock to prevent the second retaining member from axially moving.

* * * * *